US008647148B2

(12) United States Patent
Weiss

(10) Patent No.: US 8,647,148 B2
(45) Date of Patent: Feb. 11, 2014

(54) HIGH FREQUENCY INTERFACE AND CONNECTING DEVICE FOR CONNECTING A HIGH-FREQUENCY CABLE TO THE HIGH FREQUENCY INTERFACE

(75) Inventor: Frank Weiss, Bernsdorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 63 days.

(21) Appl. No.: 13/504,623

(22) PCT Filed: Oct. 20, 2010

(86) PCT No.: PCT/EP2010/006427

§ 371 (c)(1),
(2), (4) Date: Apr. 27, 2012

(87) PCT Pub. No.: WO2011/069576

PCT Pub. Date: Jun. 16, 2011

(65) Prior Publication Data

US 2012/0214340 A1 Aug. 23, 2012

(30) Foreign Application Priority Data

Dec. 9, 2009 (DE) ..... 20 2009 016 700 U

(51) Int. Cl.
*H01R 13/64* (2006.01)

(52) U.S. Cl.
USPC ..... 439/578; 439/680

(58) Field of Classification Search
USPC ..... 439/578–585, 677–681, 374, 378
See application file for complete search history.

(56) References Cited

U.S. PATENT DOCUMENTS

| | | | | | |
|---|---|---|---|---|---|
| 3,671,922 | A * | 6/1972 | Zerlin et al. | ..... | 439/352 |
| 4,229,064 | A * | 10/1980 | Vetter et al. | ..... | 439/680 |
| 4,611,878 | A * | 9/1986 | Hall et al. | ..... | 439/607.47 |
| 4,904,206 | A * | 2/1990 | Laudig et al. | ..... | 439/578 |
| 5,122,063 | A * | 6/1992 | Cooper | ..... | 439/13 |
| 5,618,190 | A * | 4/1997 | Masuda et al. | ..... | 439/98 |
| 6,267,621 | B1 * | 7/2001 | Pitschi et al. | ..... | 439/584 |
| 6,517,387 | B1 | 2/2003 | Huang | | |

FOREIGN PATENT DOCUMENTS

| | | | |
|---|---|---|---|
| DE | 29509249 | U1 | 3/1996 |
| DE | 19833923 | A1 | 2/2000 |
| DE | 102005026398 | A1 | 12/2006 |
| DE | 102008012251 | A1 | 9/2009 |
| GB | 1006429 | A | 9/1965 |

* cited by examiner

*Primary Examiner* — Gary F. Paumen

(74) *Attorney, Agent, or Firm* — DeLio & Peterson, LLC; Robert Curcio

(57) ABSTRACT

A connecting device for connecting a high-frequency (HF) cable, in particular a coaxial cable, to an HF interface, in particular a coaxial plug-in connector or hollow conductor, wherein the connecting device has a sleeve, which is formed at a first axial end for plugging with a connection part of the HF interface and at a second end axially opposite the first end for connecting to the HF cable, wherein a surface of the sleeve, which faces the connection part of the HF interface in the plugged state of the sleeve and the connection part of the HF interface, is provided with at least one first groove in the axial direction, wherein at least one cylindrical pin is provided for engaging in at least one first groove.

33 Claims, 2 Drawing Sheets

HIGH FREQUENCY INTERFACE AND CONNECTING DEVICE FOR CONNECTING A HIGH-FREQUENCY CABLE TO THE HIGH FREQUENCY INTERFACE

This application is a National Stage filing based on PCT/EP2010/006427, filed Oct. 20, 2010, and which claims priority to German Patent Application No. DE 20 2009 016 700.3, filed Dec. 9, 2009.

BACKGROUND OF THE INVENTION

1. Field of the Invention

The present invention relates to a connecting device for connecting a high-frequency (HF) cable to an HF interface. The present invention further relates to an HF interface, in particular a coaxial plug-in connector or hollow conductor, with a connection part for connecting with an HF cable, in particular a coaxial cable 2. Description of Related Art When fabricating HF cables, these are connected at their respective ends with a corresponding HF interface. This HF interface is, for example, a hollow conductor flange or an HF connector, in particular a PL connector, BNC connector, TNC connector, SMBA (FAKRA) connector, N connector, 7-16 connector, SMA connector, SMB connector, SMS connector, SMC connector or SMP connector. The expression "connector" is understood here to stand for plug connectors or bush connectors. The electrical and mechanical connection between the HF cable and the respective HF interface is usually effected by means of soldering, adhesive bonding or clamping. Through the alignment or the connection of the cable ends with the respective HF interface to a device, for example, rotational movements cause torsional moments which can loosen, damage or shear off the HF cable or the connection between the HF cable and HF interface in an undesirable manner.

SUMMARY OF THE INVENTION

The invention is based on the problem of providing a connecting device as well as an HF interface of the aforementioned type in which an angular position between HF cable and HF interface can be adjusted flexibly and simply without affecting the electrical and HF properties of the connection.

According to the invention, this problem is solved through a connecting device of the aforementioned type with the features identified in the claims and through an HF interface of the aforementioned type. Advantageous embodiments of the invention are described in the other claims.

The above and other objects, which will be apparent to those skilled in the art, are achieved in the present invention which is directed to a connecting device for connecting a high-frequency (HF) cable to an HF Interface comprising: a connection part of the HF interface including at least one first groove in the axial direction; a sleeve formed at a first axial end for plugging together with the connection part of the HF interface, wherein a surface of the sleeve which faces the connection part of the HF interface in the plugged state of the sleeve includes at least one first groove in the axial direction; and at least one cylindrical pin engaging in at least one first groove of the sleeve and the connection part of the HF interface, such that the sleeve is formed, at a second end axially opposite the first end, for connecting to the HF cable, wherein at least one second groove is formed on a surface of the HF interface facing the sleeve, the arrangement of the cylindrical pin in two first and second grooves, which are aligned with one another, blocks a rotation of the sleeve relative to the connection part fixing the relative angular position of the sleeve relative to the connection part.

The connecting device includes an outer circumference of the sleeve facing an inner circumference of the connection part of the HF interface in the plugged state of the sleeve and the connection part of the HF interface, wherein the at least one first groove is formed on a surface of the outer circumference of the sleeve.

The connecting device further includes having an inner circumference of the sleeve face an outer circumference of the connection part of the HF interface in the plugged state of the sleeve and the connection part of the HF interface, wherein the at least one first groove is formed on a surface of the inner circumference of the sleeve. The at least one first groove may extend to the first end of the sleeve.

A coupling nut may be included to provide a detachable mechanical connection with the connection part of the HF interface, the coupling nut fixing the sleeve axially to the connection part of the HF interface. The coupling nut may include a thread which engages with a corresponding thread on the connection part of the HF interface.

The connecting device may include at least two first grooves formed on the sleeve at a predetermined angular distance $\alpha$ in a radial direction. The predetermined angular distance $\alpha$ has a value of 5° to 90°. The number N of the first grooves may be represented by the value $$N=360°/\alpha.$$

The connecting device may include the at least one cylindrical pin having an outer radius of which substantially corresponds to a radius of the at least one first groove. The connecting device may further include at least two second grooves formed at an angular distance $\beta$ in a circumferential direction of 5° to 20°.

The at least one second groove formed on a surface of the inner circumference of the connection part of the HF interface, or formed on a surface of the outer circumference of the connection part of the HF interface. The at least one second groove may extend to an end of the connection part of the HF interface facing the sleeve.

The connection part of the HF interface may include an outer thread.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
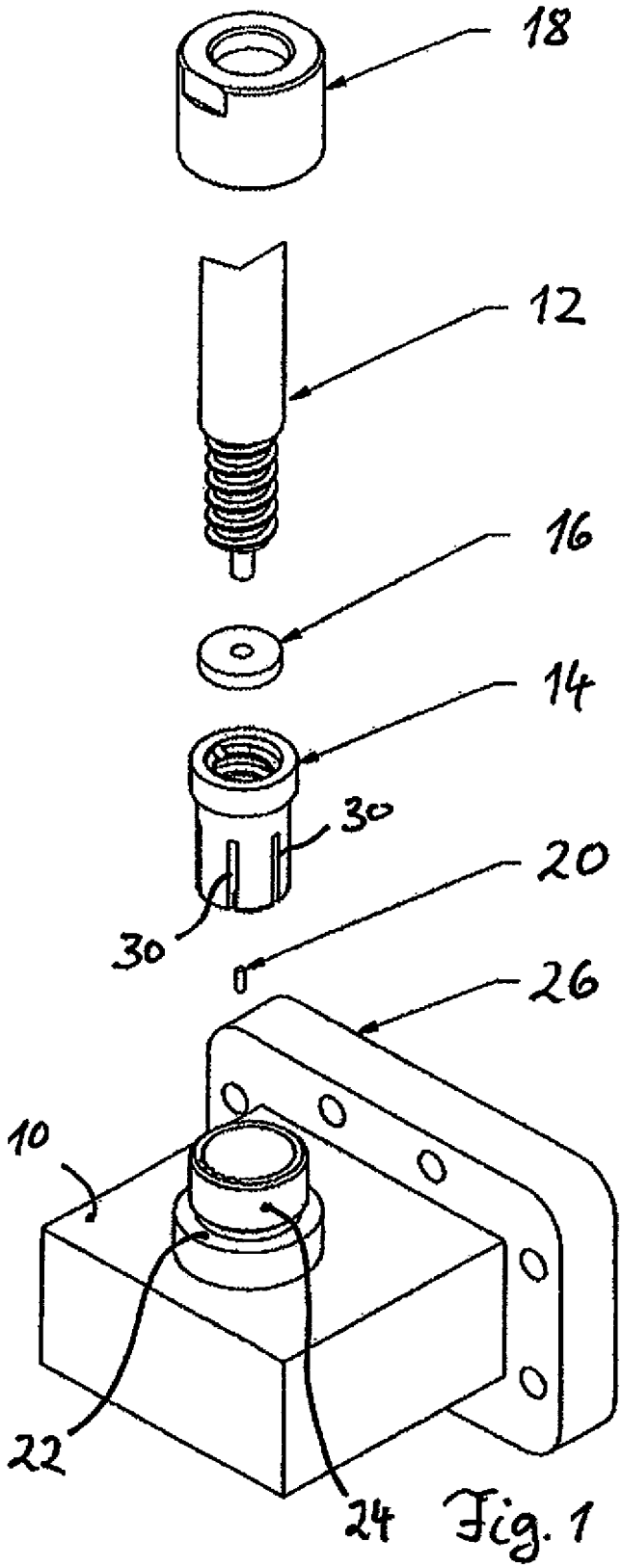
FIG. 1 shows an exploded view of a preferred embodiment of a connecting device according to the invention and an HF interface according to the invention.

In describing the preferred embodiment of the present invention, reference will be made herein to FIGS. 1-4 of the drawings in which like numerals refer to like features of the invention.

According to the invention, in a connecting device of the aforementioned type, the connecting device comprises a sleeve which is formed at a first axial end so as to plug together with a connection part of the HF interface and is formed at a second end axially opposite the first end for connection to the HF cable, wherein a surface of the sleeve which faces the connection part of the HF interface in the plugged state of the sleeve and the connection part of the HF interface is provided with at least one first groove running in an axial direction, wherein at least one cylindrical pin is provided for engaging in at least one first groove.

This has the advantage that the HF interface connected with an end of an HF cable is connected with the HF cable in a torsion-resistant yet detachable manner and consequently a desired angle between HF interface and HF cable at the location of installation appropriate to the installation situation can be adjusted, so that in the installed condition the point of connection between the HF cable and HF interface is substantially free of torsional forces. By simply inserting the cylindrical pin in a first groove when plugging together the sleeve and the connection part of the HF interface, a relative angular position between the HF cable and the HF interface is, by simple means, fixed free of play, wherein the HF properties of the connection are not affected. At the same time, the fixing of the relative angular position can be released, so that even with a subsequent change in the installation position of the HF cable or the devices connected with this, a different relative angular position can be adjusted and fixed.

An engagement of the sleeve in the connection part of the HF interface is achieved in that the sleeve is formed in such a way that, in the plugged state of the sleeve and the connection part of the HF interface, an outer circumference of the sleeve faces an inner circumference of the connection part of the HF interface, wherein the at least one first groove is formed on a surface of the outer circumference of the sleeve.

An outer enclosure of the sleeve around the connection part of the HF interface is achieved in that the sleeve is formed in such a way that, in the plugged state of the sleeve and the connection part of the HF interface, an inner circumference of the sleeve faces an outer circumference of the connection part of the HF interface, wherein the at least one first groove is formed on a surface of the inner circumference of the sleeve.

A particularly simple plugging-together of the sleeve and the connection part of the HF interface is achieved in that the at least one first groove extends up to the first end of the sleeve.

In order to create a detachable connection between the connecting device and the HF interface, a coupling nut is provided which, in order to provide a detachable mechanical connection with the connection part of the HF interface, is so formed that the coupling nut fixes the sleeve axially to the connection part of the HF interface.

A particularly simple detachable connection is achieved in that the coupling nut possesses a thread, in particular an inner thread, which engages with a corresponding thread on the connection part of the HF interface.

In order to improve the adjustability of different angles between the sleeve and the connection part of the HF interface, at least two first grooves with a predetermined angular distance $\alpha$ in a radial direction are formed on the sleeve. The predetermined angular distance $\alpha$ has a value of from 5° to 90°, for example, in particular 15° or 60°.

A rotationally symmetrical arrangement of the first grooves is achieved in that a number N of the first grooves has the value $$N = \frac{360°}{\alpha}.$$

A particularly good fit and fixing between the sleeve and the connection part of the HF interface is achieved in that the connecting device possesses at least one cylindrical pin, the outer radius of which substantially corresponds to a radius of the at least one first groove.

According to the invention, in an HF interface of the aforementioned type, a connecting device with a sleeve is provided, wherein the connecting device is formed as described above.

This has the advantage that the HF interface connected with an end of an HF cable is connected with the HF cable in a torsion-resistant yet detachable manner and consequently a desired angle between HF interface and HF cable at the location of installation appropriate to the installation situation can be adjusted, so that in the installed condition the point of connection between the HF cable and HF interface is substantially free of torsional forces. By simply inserting the cylindrical pin in a first groove when plugging together the sleeve and the connection part of the HF interface, a relative angular position between the HF cable and the HF interface is, by simple means, fixed free of play, wherein the HF properties of the connection are not affected. At the same time, the fixing of the relative angular position can be released, so that even with a subsequent change in the installation position of the HF cable or the devices connected with this, a different relative angular position can be adjusted and fixed.

An additional fixing of the angular position between HF interface and HF cable with a further improvement of the HF properties of the connection is achieved in that at least one second groove is formed on a surface of the HF interface facing the sleeve.

For a particularly good fine adjustment of the angular position between HF interface and HF cable, at least two second grooves are formed, at an angular distance in a circumferential direction of 5° to 20°, in particular 15°.

An engagement of the sleeve in the connection part of the HF interface is achieved in that the connecting device is formed, wherein the at least one second groove is formed on a surface of the inner circumference of the connection part of the HF interface.

An outer enclosure of the sleeve around the connection part of the HF interface is achieved in that the at least one second groove is formed on a surface of the outer circumference of the connection part of the HF interface.

A particularly simple plugging-together of the sleeve and the connection part of the HF interface is achieved in that the at least one second groove extends up to an end of the connection part of the HF interface facing the sleeve.

A particularly simple detachable connection between the HF cable and the HF interface is achieved in that the connection part of the HF interface possesses an outer thread.

The preferred embodiment of a connecting device according to the invention shown in FIG. 1 is shown with an HF interface 10 according to the invention in the form of a hollow conductor with a coaxial hollow conductor interface. However, this is simply by way of example. Instead of being formed as a hollow conductor, the HF interface 10 can also be formed as an HF coaxial plug-in connector with a corresponding plug interface in the form of a bush or plug connector. The connecting device connects the HF interface 10 with an HF cable 12, which in FIG. 1 is shown by way of example in the form of a coaxial corrugated cable.

The connecting device possesses a sleeve 14, a supporting element 16, a coupling nut 18 and a cylindrical pin 20. The HF interface 10 possesses a connection part 22 with an outer thread 24 and a hollow conductor flange 26. The sleeve 14 is formed in such a way that this can be plugged into the connection part 22, so that a surface of an outer circumference of the sleeve 14 faces a surface of an inner circumference of the connection part 22. However, in an alternative embodiment it is possible that the sleeve encloses the connection part 22 over a predetermined axial section, so that a surface of an outer circumference of the connection part 22 faces a surface of an inner circumference of the sleeve 14.

Figure 2:
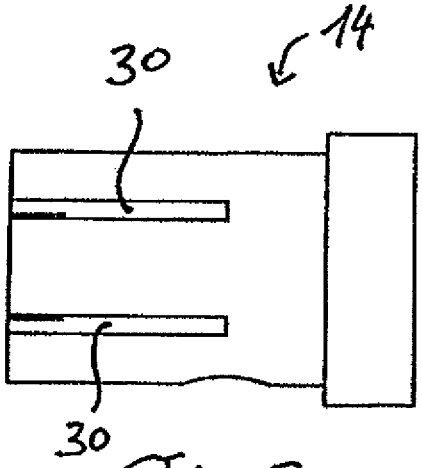
FIG. 2 shows a side view of a sleeve of a connecting device according to the invention.
Figure 3:
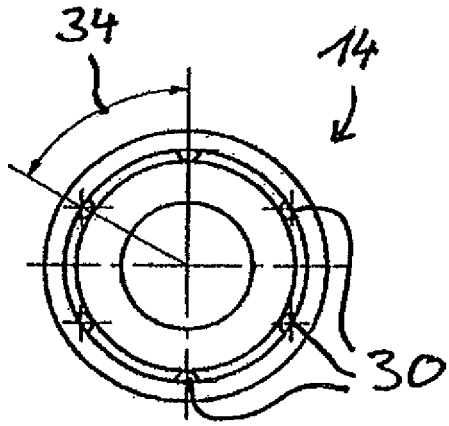
FIG. 3 shows a front view of the sleeve according to FIG. 2.
Figure 4:
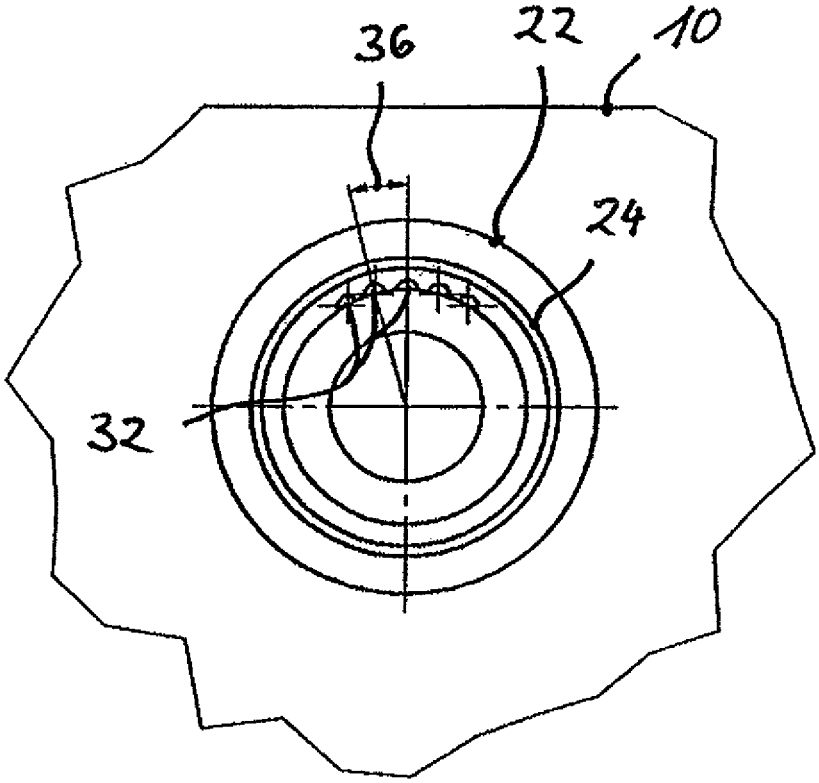
FIG. 4 shows a front view of a connection part of the HF interface.

As can be seen in particular from FIGS. 2 and 3, several first grooves 30 are formed on the outer circumference of the sleeve 14. As can be seen in particular from FIG. 4, several second grooves 32 are formed on the inner circumference of the connection part 22. The first and second grooves 30, 32 are formed and arranged such that with the sleeve 14 aligned at a corresponding angle relative to the connection part 22 at least one first groove 30 aligns with a second groove 32, forming between them a space to accommodate the cylindrical pin 20. Through the arrangement of the cylindrical pin 20 in two first and second grooves 30, 32 which are aligned with one another, a rotation of the sleeve 14 relative to the connection part 22 is blocked, so that the relative angular position of the sleeve 14 relative to the connection part 22 is fixed.

For a rough adjustment of the angular position between the sleeve 14 and the connection part 22, six first grooves 30 are formed on the outer circumference of the sleeve 14, spaced equally around the circumference at an angle $\alpha$34 with a value $\alpha=60°$. For a fine adjustment of the angular position between the sleeve 14 and the connection part 22, five second grooves 32, spaced at an angle $\beta$36 with a value $\beta=15°$, are formed on the connection part 22.

The coupling nut engages, by means of a corresponding inner thread, via the sleeve 14, with the outer thread 24 of the connection part 22, and in screwed-on condition fixes the sleeve 14 in the connection part 22 in an axial direction. The sleeve 14 is at the same time connected firmly with the HF cable 12 or with its corrugated sheathing or with its outer conductor, so that in this way the HF cable 12 is connected electrically and mechanically with the HF interface 10. By simply unscrewing the coupling nut 18 from the connection part 22 and withdrawing the sleeve 14 axially from the connection part 22, this connection can be detached, and a relative angular position between the sleeve 14 and the connection part 22, and thus between HF cable 12 and HF interface 10, can be altered. As soon as a new desired angular position has been achieved, the sleeve 14 is again pushed into the connection part 22, with the cylindrical pin between two aligning grooves 30, 32, and the coupling nut 18 is screwed again onto the connection part 22. In this way an angular position between the HF cable 12 and the HF interface 10 can at any time be adapted to a new installation situation such that the HF interface 10 can be connected to a device without torsional strain on the HF cable 12. For this purpose it is no longer necessary for a new HF cable with a new HF interface to be fabricated. Furthermore, when fabricating the HF cable with respective HF interfaces 10, it is also no longer necessary to take into consideration the later installation situation of the HF cable 12 when attaching the HF interfaces 10 to the HF cable 12. The adaptation to the location of installation of the HF cable 12 can be effected simply in the manner described above.

The formation of the connection between the sleeve 14 and the connection part 22 with grooves 30, 32 and a cylindrical pin 20 means that a very precisely-fitting manufacture of the components is possible, so that the connection between the sleeve 14 and the connection part 22 can be realized substantially free of play. This is particularly important in order to achieve good HF properties of the connection, so that this type of connection of HF cable 12 and HF interface 10 can also be used for very high-frequency signals without significant losses or signal distortions.

The connecting device described above is a multiple connecting element designed, independently of its fabrication, to absorb forces and moments which effectively prevents damage to the components which are to be connected and thus guarantees full functionality under mechanical strain. The connection can be detached simply and the relative angle of alignment of HF interface 10 and HF cable 12 can be altered and adjusted to the current installation situation for the HF cable 12.

The grooves 30, 32 are preferably formed such that these each form half of a hollow cylinder into which the cylindrical pin 20 fits (fitted key-groove principle).

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A connecting device for connecting a high-frequency (HF) cable to an HF Interface comprising:

a connection part of the HF interface including at least one first groove in the axial direction;

a sleeve formed at a first axial end for plugging together with the connection part of the HF interface, wherein a surface of the sleeve which faces the connection part of the HF interface in the plugged state of the sleeve includes at least one first groove in the axial direction; and at least one cylindrical pin engaging in at least one first groove of the sleeve and the connection part of the HF interface, such that the sleeve is formed, at a second end axially opposite the first end, for connecting to the HF cable, wherein at least one second groove is formed on a surface of the HF interface facing the sleeve, the arrangement of the cylindrical pin in two first and second grooves, which are aligned with one another, blocks a rotation of the sleeve relative to the connection part fixing the relative angular position of the sleeve relative to the connection part.

2. The connecting device of claim 1 including having an outer circumference of the sleeve face an inner circumference of the connection part of the HF interface in the plugged state of the sleeve and the connection part of the HF interface, wherein the at least one first groove is formed on a surface of the outer circumference of the sleeve.

3. The connecting device of claim 1 including having an inner circumference of the sleeve face an outer circumference of the connection part of the HF interface in the plugged state of the sleeve and the connection part of the HF interface wherein the at least one first groove is formed on a surface of the inner circumference of the sleeve.

4. The connecting device of claim 1 wherein the at least one first groove extends to the first end of the sleeve.

5. The connecting device of claim 1 including a coupling nut is to provide a detachable mechanical connection with the connection part of the HF interface, the coupling nut fixing the sleeve axially to the connection part of the HF interface.

6. The connecting device of claim 5 wherein the coupling nut includes a thread, which engages with a corresponding thread on the connection part of the HF interface.

7. The connecting device of claim 1 including at least two first grooves formed on the sleeve at a predetermined angular distance $\alpha$ in a radial direction.

8. The connecting device of claim 7 wherein the predetermined angular distance $\alpha$ has a value of 5° to 90°.

9. The connecting device of claim 7 wherein a number N of the first grooves has the value $$N = \frac{360°}{\alpha}.$$

10. The connecting device of claim 1 including the at least one cylindrical pin having outer radius of which substantially corresponds to a radius of the at least one first groove.

11. The connecting device of claim 1 including at least two second grooves formed at an angular distance $\beta$ in a circumferential direction of 5° to 20°.

12. The connecting device of claim 2 including the at least one second groove formed on a surface of the inner circumference of the connection part of the HF interface.

13. The connecting device of claim 1 including the at least one second groove is formed on a surface of the outer circumference of the connection part of the HF interface.

14. The connecting device of claim 1 wherein the at least one second groove extends to an end of the connection part of the HF interface facing the sleeve.

15. The connecting device of claim 1 wherein the connection part of the HF interface possesses an outer thread.

16. The connecting device of claim 2 wherein the at least one first groove extends to the first end of the sleeve.

17. The connecting device of claim 3 wherein the at least one first groove extends to the first end of the sleeve.

18. The connecting device of claim 16 including a coupling nut to provide a detachable mechanical connection with the connection part of the HF interface, the coupling nut fixing the sleeve axially to the connection part of the HF interface.

19. The connecting device of claim 17 including a coupling nut to provide a detachable mechanical connection with the connection part of the HF interface, the coupling nut fixing the sleeve axially to the connection part of the HF interface.

20. The connecting device of claim 18 wherein the coupling nut includes a thread which engages with a corresponding thread on the connection part of the HF interface.

21. The connecting device of claim 19 wherein the coupling nut includes a thread which engages with a corresponding thread on the connection part of the HF interface.

22. The connecting device of claim 16 wherein the at least one first groove includes at least two first grooves formed on the sleeve at a predetermined angular distance $\alpha$ in a radial direction.

23. The connecting device of claim 17 wherein the at least one first groove includes at least two first grooves formed on the sleeve at a predetermined angular distance $\alpha$ in a radial direction.

24. The connecting device of claim 22 wherein the predetermined angular distance $\alpha$ has a value of 5° to 90°.

25. The connecting device of claim 23 wherein the predetermined angular distance $\alpha$ has a value of 15° to 60°.

26. The connecting device of claim 22 wherein the predetermined angular distance $\alpha$ has a value of 15° to 60°.

27. The connecting device of claim 23 wherein the predetermined angular distance $\alpha$ has a value of 5° to 90°.

28. The connecting device of claim 8 wherein a number N of the first grooves has the value $$N = \frac{360°}{\alpha}.$$

29. The connecting device of claim 4 including the at least one second groove formed on a surface of the inner circumference of the connection part of the HF interface.

30. The connecting device of claim 11 including the at least one second groove formed on a surface of the inner circumference of the connection part of the HF interface.

31. The connecting device of claim 3 including the at least one second groove formed on a surface of the outer circumference of the connection part of the HF interface.

32. The connecting device of claim 4 including the at least one second groove formed on a surface of the outer circumference of the connection part of the HF interface.

33. The connecting device of claim 11 including the at least one second groove formed on a surface of the outer circumference of the connection part of the HF interface.

* * * * *